United States Patent [19]

Hayashi

[11] Patent Number: 4,678,962

[45] Date of Patent: Jul. 7, 1987

[54] IMAGE PICKUP TUBE

[75] Inventor: Masatake Hayashi, Kanagawa, Japan

[73] Assignee: Sony Corporation, Tokyo, Japan

[21] Appl. No.: 795,315

[22] Filed: Nov. 6, 1985

[30] Foreign Application Priority Data

Nov. 7, 1984 [JP] Japan ..... 59-234599

[51] Int. Cl.[4] ..... H01J 29/08; H01J 31/38

[52] U.S. Cl. ..... 313/383; 313/390; 313/456

[58] Field of Search ..... 313/348, 349, 383, 390, 313/476, 456

[56] References Cited

U.S. PATENT DOCUMENTS

| | | | |
|---|---|---|---|
| 3,860,851 | 1/1975 | Hamersma | 313/390 X |
| 3,876,897 | 4/1975 | Geyer | 313/390 |
| 3,906,278 | 9/1975 | Horton et al. | 313/383 |
| 4,347,459 | 8/1982 | Benner | 313/383 |

*Primary Examiner*—David K. Moore
*Assistant Examiner*—K. Wieder

[57] ABSTRACT

In an image pickup tube comprising a glass bulb, a face plate, a target surface, a mesh electrode arranged in opposition to the target surface, and a mesh holder to support the mesh electrode, the mesh electrode having supported with non-uniform tension at various portions thereof by the mesh holder whereby microphonic noise is attenuated rapidly.

1 Claim, 11 Drawing Figures

8A

8B

8B

8B

IMAGE PICKUP TUBE

BACKGROUND OF THE INVENTION

1. Field of the Invention

The present invention relates to image pickup tubes.

2. Description of the Prior Art

FIG. 10 is a sectional view of an image pickup tube in the prior art illustrating the construction adjacent the target surface. In FIG. 10, reference numeral 1 designates a glass bulb, numeral 2 a face plate, numeral 3 a target surface (photo conductive layer surface), numeral 4 indium for sealing, and numeral 5 a metal ring. Numeral 6 designates a signal carrying electrode which passes through the face plate 2 and contacts with the target surface 3. Numeral 7 designates a mesh electrode to correct the landing error of the electron beam. The mesh electrode 7 is mounted on a mesh holder 8 which is connected mechanically and electrically to the indium 4. Predetermined voltage is applied to the mesh electrode 7 through the metal ring 5, the indium 4 and the mesh holder 8.

In such an image pickup tube of the prior art, however, when forces are applied thereto from outside, so-called microphonic noise may be produced and a lateral stripe may appear on the screen surface. It is known that such microphonic noise is caused by vibration of the mesh electrode 7. That is, since the mesh electrode 7 is disposed near the target surface 3, if the mesh electrode 7 is vibrated, current is generated through capacitance between the mesh electrode 7 and the target surface 3 and introduced as noise in the signal current resulting in microphonic noise.

In order to reduce the microphonic noise, various methods to suppress vibration of the mesh electrode have been tried. However, the methods have problems in complicated structure high cost and insufficient effect.

It is believed that the reason microphonic noise is conspicuous in an image pickup tube of the prior art is that ince the rectangular opening of the mesh holder 8 has periphery of uniform shape, the mesh electrode 7 after recrystallization treatment at high temperature, i.e., so-called annealing treatment, has uniform tension in various portions, whereby a stable standing wave is generated during vibration, and attenuation of the vibration of the mesh electrode 7 is slow and the microphonic noise becomes conspicuous.

SUMMARY OF THE INVENTION

In view of such problems in the prior art, an object of the invention is to provide an image pickup tube in which the microphonic noise is reduced and anti-vibration property is improved simply at low cost.

In order to solve the above-mentioned problems, an image pickup tube of the invention comprises a mesh electrode 7 which is arranged in opposition to a target surface 3 and supported with non-uniform tension at various portions thereof by the mesh holder 9. For example, rectangular openings 9, 12 of th mesh holder 8 have respective sides *9a*, *9b*, *12a*, *12b* pressed into circular arc form.

Since the mesh electrode 7 is supported with non-uniform tension at various portions thereof, generation of a stable standing wave is prevented during the vibration, and attenuation of the vibration of the mesh electrode 7 is rapid, and microphonic noise is reduced.

DESCRIPTION OF THE PREFERRED EMBODIMENT

Figure 1:
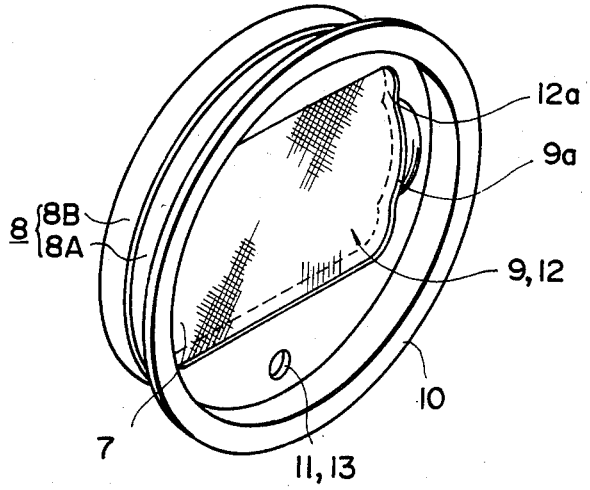
FIG. 1 is a perspective view of a portion of an image pickup tube embodiment of the invention illustrating construction of a mesh electrode and a mesh holder.

An embodiment of the invention will now be described referring to FIG. 1. FIG. 1 shows a mesh electrode 7 and a mesh holder 8 in an image pickup tube that is an embodiment of the invention.

Figure 2:
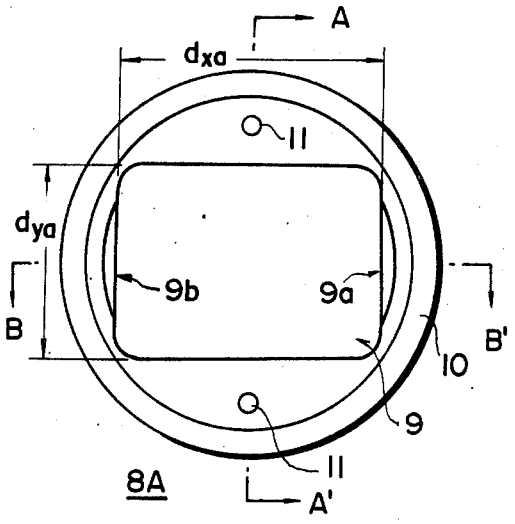
FIG. 2 is a front view of the target-surface-side element of the mesh holder.
Figure 3:
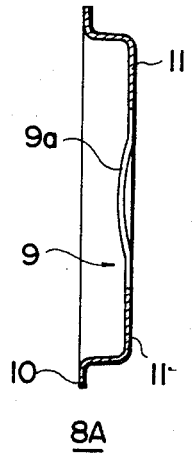
FIG. 3 is a sectional view taken in line A—A′ of FIG. 2.
Figure 4:
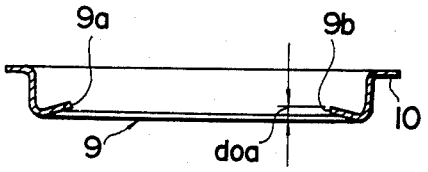
FIG. 4 is a sectional view taken in line B—B′ of FIG. 2.
Figure 10:
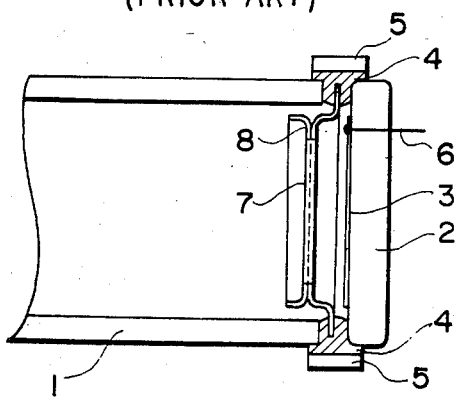
FIG. 10 (PRIOR ART)
FIG. 10 is a sectional view of an example of an image pickup tube in the prior art.

The mesh holder 8 is composed of a target surface-side element or member 8A and a cathode-side element or member 8B. The target surface-side member 8A has form as shown in FIG. 2. FIGS. 3 and 4 are sectional views taken in line A—A′ and line B—B′ of FIG. 2, respectively. The member 8A as a whole is of cylindrical form. One end (cathode side) of the member 8A is provided with an opening 9 of rectangular form, and other end (target surface side) thereof is provided with a projection 10 to be fixed to indium 4 (refer to FIG. 10). Construction hereinbefore described is similar to the prior art. In the embodiment of the invention, however, for example, one set of sides *9a*, *9b*, in the horizontal direction framing the opening 9 are made of segmental spherical form enlarged, or swollen to the target surface side. In the case of a tube of ½ inch (target diagonal size), for example when horizontal length dxa and vertical length dya of the opening 9 are about 8.7 mm and 6.3 mm respectively, the maximum displacement amount doa of the sides *9a*, *9b* is made 0.15–0.20 mm.

In FIGS. 2 and 3, numeral 11 designates a through hole for locating and positioning the member 10.

Figure 5:
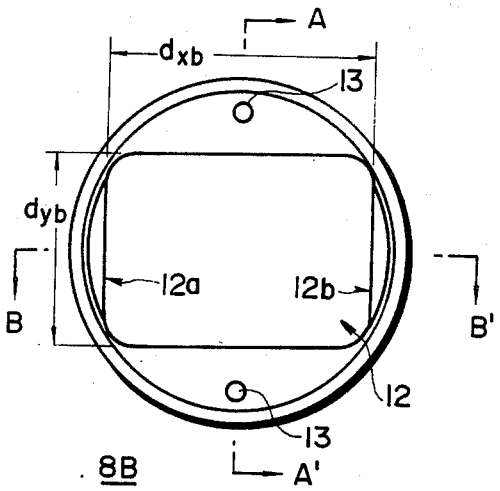
FIG. 5 is a front view of the cathode-side element of the mesh holder.
Figure 6:
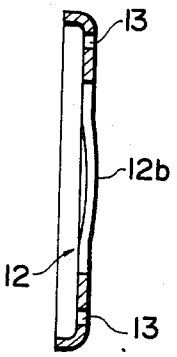
FIG. 6 is a sectional view taken in line A—A′ of FIG. 5.
Figure 7:
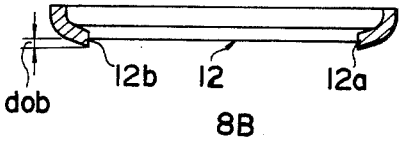
FIG. 7 is a sectional view taken in line B—B′ of FIG. 5.

The cathode side element or member 8B has form as shown in FIG. 5. FIGS. 6 and 7 are sectional views taken in line A—A′ and line B—B′ of FIG. 5, respectively. The member 8B as a whole is of cylindrical form. One end (target surface side) is provided with an opening 12 of rectangular form. The opening 12 has the same size as that of the opening 9 in the member 8A. Its construction as hereinbefore noted is similar to the prior art, but in the inventive embodiment, however, one set of sides *12a*, *12b* constituting the opening 12 are made circular arc form pressed to the target surface side, with the surface including the sides *12a*, *12b* made spherical in form. In the case of a tube of ½ inch size, for example, when horizontal length dxb and vertical length dyb of the opening 12 are about 8.7 mm and 6.3 mm respectively, the maximum displacement amount dob of the sides 12*a*, 12*b* is made 0.15–0.20 mm. Consequently, when the openings 9 and 12 of the members 8A and 8B are overlaid with each other, the surface including the sides 9*a*, 9*b* and the surface including the sides 12*a*, 12*b* are inter-fitted.

In FIGS. 5 and 6, numeral 13 designates a through hole for positioning.

In FIG. 1, in order that the mesh electrode 7 is interposed between the openings 9 and 12 of both members 8A and 8B of the mesh holder 8 as above constructed and the openings 9 and 12 are overlaid with each other, the members 8A and 8B are welded by spot welding, for example, and the mesh electrode 7 is stretched between the openings 9 and 12. After being stretched, the mesh electrode 7 is treated by recrystallization at high temperature, i.e., so-called annealing treatment in a manner similar to the prior art.

The mesh electrode 7 and the mesh holder 8 in the embodiment are constituted as above described, and other parts are constituted in similar manner to the prior art.

In the embodiment of the invention illustrated, since the rectangular openings 9, 12 of the mesh holder 8 to support the mesh electrode 7 have each one side of sides 9*a*, 9*b*, 12*a*, 12*b* pressed into circular arc form, the mesh electrode 7 is formed in saddle-like slow curve after so-called annealing treatment. In the annealing treatment, the mesh electrode 7 is pulled from the mesh holder 8 under approximately uniform tension. However, according to construction of such curved surface, uniformity of the tension is locally lost at each point of the mesh electrode 7 and the tension has anisotropy.

Even if the mesh electrode 7 is vibrated by an external force, for example, generation of a stable standing wave is prevented and attenuation of the vibration is made rapid.

According to the embodiment as above described, the vibration of the mesh electrode 7 is attenuated more rapidly, the microphone noise is reduced and the anti-vibration property is substantially improved.

Figure 8:
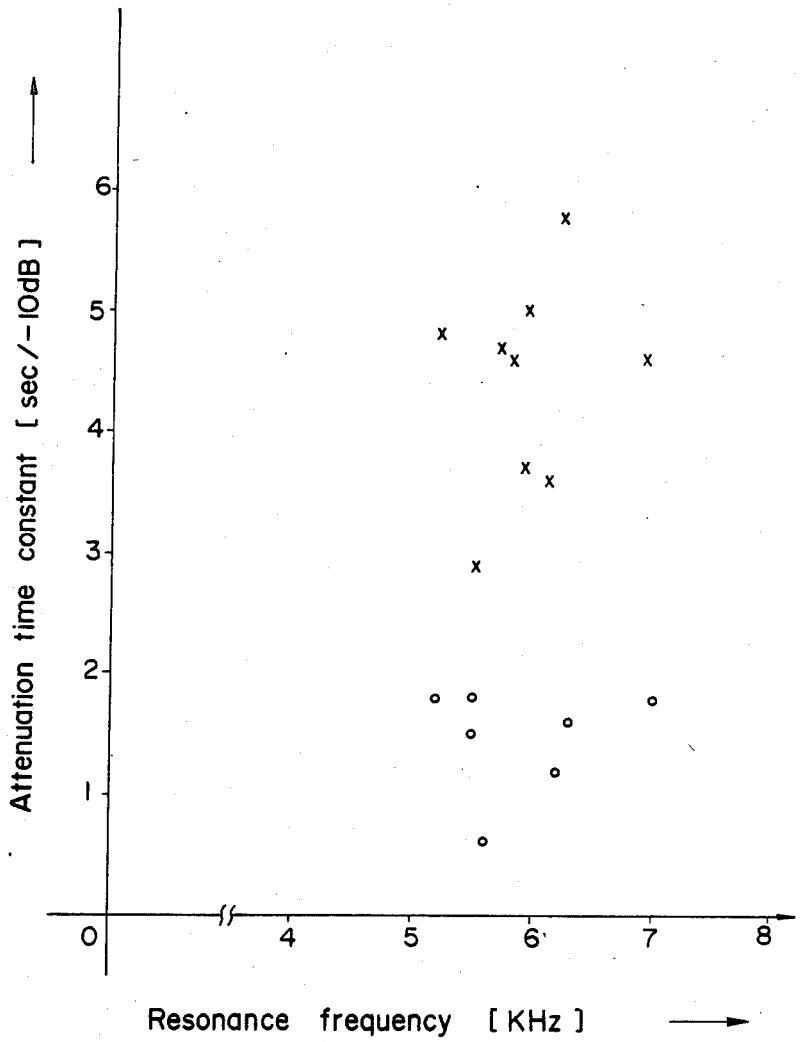
FIG. 8 is a graph illustrating the erlation between attenuation rate of microphonic noise and resonant frequency of the mesh electrode.
Figure 9A:
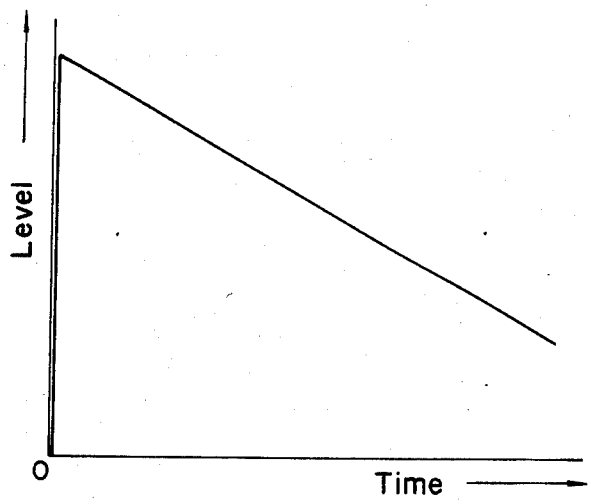
FIGS. 9A and 9B are graphs illustrating attenuation transient characteristics of microphonic noise.
Figure 9B:
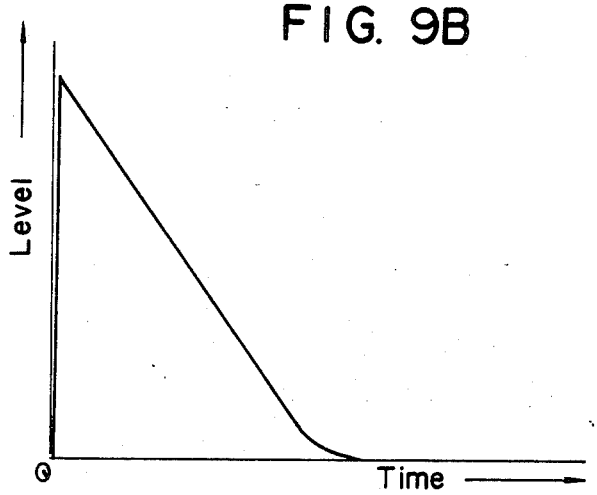

FIG. 8 shows measured results in attenuation rate of microphonic noise and resonance frequency of the mesh electrode 7 comprising an example in the prior art (shown by (x)) and the inventive embodiment (shown by (o). It is seen from the graph that the embodiment is attanuated at rate more than twice of that of the conventional example. FIGS. 9 (A) (B) shows actual attenuation transient characteristics of the microphonic noise regarding the conventional example 9A and the embodiment of the invention 9B.

According to the invention, special process or material is not required but attentuation of the microphonic noise can be accomplished merely by changing shape of the members 8A, 8B of the mesh holder 8 simply at low cost.

As a result of the experiments, changing of shape of the members 8A,8B of the mesh holder 8 does not affect characteristics of the image pickup tube.

Although two sides in the horizontal direction of the openings 9, 12 are made sequential spherical arc form according to the embodiment illustrated, two sides in the vertical direction may be so treated and/opr the swelling or pressing direction may be reversed to the cathode side. Furthermore, although two sides are pressed according to the illustrated embodiment, a gentle curve so as not to damage the mesh electrode will suffice, and the circular arc form illustrated is not necessarily required. Although shape of the openings 9, 12 is rectangular according to the embodiment, it may be circular.

According to the invention as above described, since the mesh electrode is supported with non-uniform tension in various portions thereof, generation of a stable standing wave is prevented during externally induced vibration, and attenuation of the vibration of the mesh electrode is rapid. Consequently, microphonic noise is reduced and the anti-vibration property of the electrode is improved. Furthermore, according to the invention, special process or material is not required but attenuation of the microphonic noise can be obtained by merely changing shape of the mesh holder simply, and at low cost.

I claim as my invention:

1. An image pick-up tube, comprising a glass bulb, a face plate, a target surface, a mesh electrode arranged in opposition to the target surface and a mesh holder to support said mesh electrode comprising a pair of elements each having an opening of rectangular form, wherein one pair of diametrically opposing sides constituting said opening in each of said elements is formed with a segmental spherical surface including a portion of said sides, whereby said mesh electrode is curved between said elements such that the tension is non-uniform over said mesh electrode and the tension of said electrode has anisotropy.

* * * * *